United States Patent [19]

Okabayashi

[11] 4,091,778

[45] May 30, 1978

[54] VACUUM ADVANCER SYSTEM FOR A GASOLINE ENGINE

[75] Inventor: Keiichi Okabayashi, Miyoshi, Japan

[73] Assignee: Toyota Jidosha Kogyo Kabushiki Kaisha, Toyota, Japan

[21] Appl. No.: 649,549

[22] Filed: Jan. 15, 1976

[30] Foreign Application Priority Data

Jul. 11, 1975 Japan ..... 50-85578

[51] Int. Cl.[2] ..... F02P 5/14

[52] U.S. Cl. ..... 123/117 A

[58] Field of Search ..... 123/117 A

[56] References Cited

U.S. PATENT DOCUMENTS

| | | | |
|---|---|---|---|
| 2,249,446 | 7/1941 | Vanderpoel | 123/117 A |
| 2,659,353 | 11/1953 | Mallory | 123/117 A |
| 3,494,338 | 2/1970 | Reise | 123/117 A |
| 3,638,626 | 2/1972 | Marshall | 123/117 A |
| 3,707,954 | 1/1973 | Nakada | 123/117 A |
| 3,800,759 | 4/1974 | Cedar | 123/117 A |
| 3,923,023 | 12/1975 | Ito | 123/117 A |
| 3,948,232 | 4/1976 | Gould | 123/117 A |

*Primary Examiner*—Douglas Hart

[57] ABSTRACT

An improvement in a vacuum advancer which controls the ignition timing of a gasoline engine responding to an engine load comprises a first pipe which is connected between a port in a wall of a carburetor adjacent a throttle valve and a diaphragm chamber of a distributor, a second pipe provided between another port in the wall of a carburetor adjacent the throttle valve and the first pipe, the second pipe being provided with a heat sensitive valve and a restricted orifice that make the second pipe communicable with the first pipe after the engine has been warmed. Thus the negative pressure therein escapes through the second pipe for said port in a wall of a carburetor adjacent the throttle valve so that the advance angle for the distributor becomes lagged, and the engine is prevented from overheat to the result that suppress generation of $NO_x$ in the exhaust.

8 Claims, 2 Drawing Figures

VACUUM ADVANCER SYSTEM FOR A GASOLINE ENGINE

BACKGROUND OF THE INVENTION

The present invention relates to an ignition displacement angle control device for a gasoline engine.

The conventional vacuum type ignition displacement angle control device for a gasoline engine is of such a design that timing for ignition is conducted by virtue of a load applied to the gasoline engine, wherein a negative pressure intake port is formed through the wall of a vaporizer and any fluctuation in the degree of the vacuum therein is caused to act on the diaphragm chamber of a distributor. The base plate of the case or the arm of an interrupter is caused to resolve by means of a linking mechanism that is fixed in place on the diaphgram, whereby the ignition timing is changed. The conventional ignition displacement angle control device is so designed that ignition timing is caused to be delayed during the racing of the gasoline engine and at the time of operation thereof under the total load as well, and high level partial vacuum functions on the said diaphragm at the time of operation under the intermediate load, thus causing the ignition time to be advanced.

However, as rigid controls over the exhaust gas have recently been instituted, the prior art method of advancing the ignition time under the intermediate load using a conventional vacuum type ignition displacement angle control device, for example by opening the throttle valve of a vaporizer to some certain degree, has the effect that the ignition time can hardly be advanced to a satisfactory level in some case. Such being the situation, now that the combustion temperature in the engine cylinder is required to be reduced down to as low a level as practicable for the purpose of reducing the quantity of $NO_x$ generated in a gasoline engine, it is desireable that the ignition time be delayed as much as possible in order to meet the requirement.

BRIEF SUMMARY OF THE INVENTION

The purpose of the present invention is to provide a gasoline engine ignition displacement angle control device of a new construction as is specifically designed to reduce the quantity of $NO_x$ to be exhausted out of the gasoline engine, by reducing the displacement of the ignition time down to a lower level than in the case of any conventional gasoline engine at the time of driving a gasoline engine-driven vehicle after warm-up.

The subject matter of the present invention lies in providing such a gasoline engine ignition displacement angle control device having a negative pressure pipeline that makes connection with a negative pressure port opening through the wall of a vaporizer of a gasoline engine at a spot adjacent to the valve-closing position of a throttle valve for mixed air in the said vaporizer with a diaphragm chamber of a distributor, and a pressure-inducing pipeline connected to another port formed to open through the wall of the vaporizer at a spot slightly above the negative pressure port and a temperature sensitive valve specifically designed so as to be opened only during the warming-up of the gasoline engine connected with the other port. Also provided is a restricted orifice arranged thereon. The gasoline engine ignition displacement angle control device of this invention is also provided with a retarding valve, comprising a one-way valve and a restricted orifice, as is specifically designed so as to be caused to open instantly only in case the negative pressure on the side of the said diaphragm chamber is higher in value than the negative pressure on the other side, in such a pipeline as makes connection with the diaphragm chamber of the distributor with the connecting portion between the negative pressure pipeline and a pressure-inducing pipeline.

DETAILED DESCRIPTION OF THE INVENTION

Figure 1:
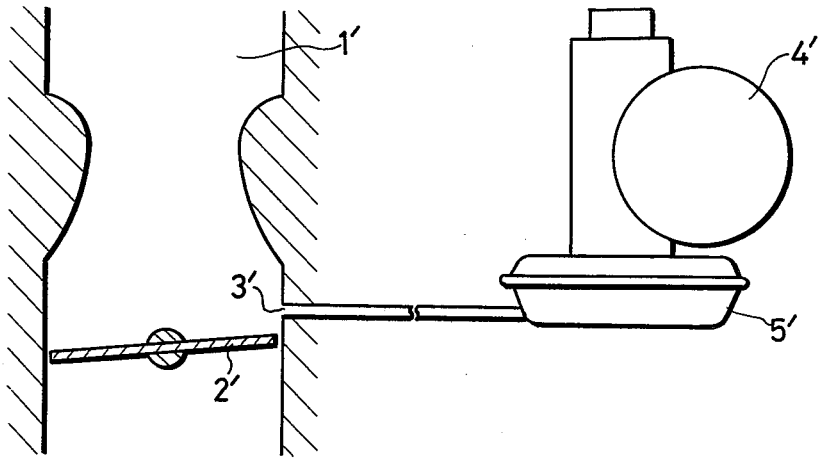
FIG. 1 PRIOR ART
FIG. 1 is a schematic view illustrating one example of the conventional prior art ignition displacement angle control device.

Given below will be a detailed description of the present invention with reference being made to one embodiment thereof shown in the drawing attached hereto. A schematic view of one example of the conventional ignition displacement angle control device is shown in FIG. 1. In FIG. 1 when the throttle valve 2' of a vaporizer 1' opens in some degree, negative pressure functions on the negative pressure port 3' connected with a diaphragm chamber 5' of a conventional manifest distributor 4', thus causing the diaphragm of the distributor 4' to be moved, whereby the ignition time is caused to be advanced. However, this results in advancing the ignition time for the gasoline engine, until the temperature of the exhaust of the engine is raised up too high a level, thus possibly constituting a cause of generation of $NO_x$.

Figure 2:
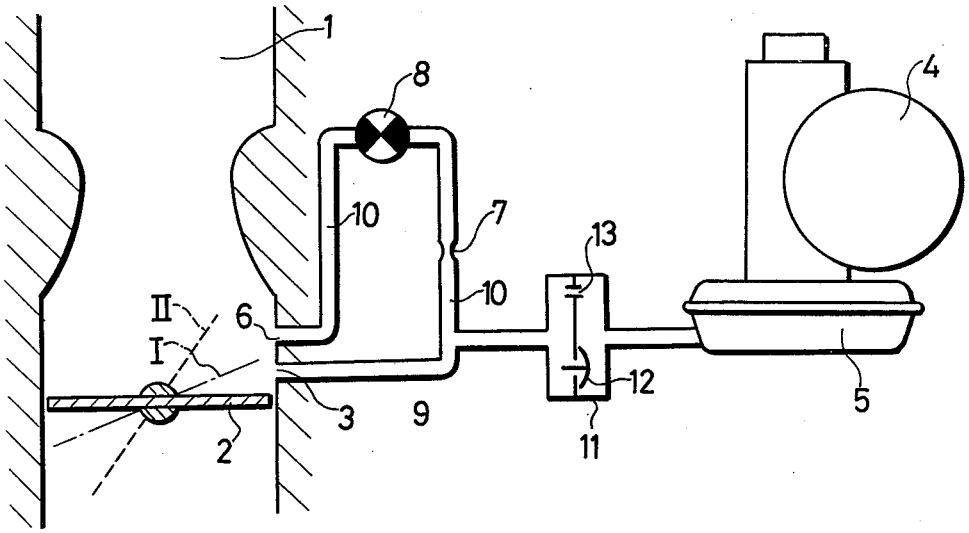
FIG. 2 is a schematic illustration of one embodiment of the present invention.

Shown in FIG. 2 is a schematic drawing of one embodiment of the present invention. In this embodiment, the negative pressure port 3 of the vaporizer 1 is so formed as to open through the wall of the vaporizer at a position slightly above the end of the throttle valve 2 at the time of its being set virtually at the closing position thereof. Another port 6 is so formed as to open at a slightly higher position than the negative pressure port 3. The negative pressure port 3 is connected with a negative pressure pipeline 9, and is furthermore connected with a diaphragm chamber 5 of a conventional manifest distributor 4 through a retarding valve 11, thus forming a negative pressure passageway. A pressure-inducing pipeline 10 is connected with the port 6 in such a manner as to be in parallel with the negative pressure passageway 9. Also connected with the pressure-inducing pipeline 10 are a temperature sensitive valve 8 and a restricted orifice 7. The negative pressure pipeline 9, running from the port 3 to the diaphragm chamber 5, is also connected to the pressure-inducing pipeline 10 at a position that is upstream of the retarding valve 11. The temperature sensitive valve 8 is specifically designed so as to sense whether or not the gasoline engine is properly warmed up by the temperature of water of the gasoline engine. For instance the temperature sensitive valve 8 may be of the type having a substance like wax that is rendered meltable at a designated level of temperature. An example of a temperature sensitive or thermostatically responsive valve is disclosed in U.S. Pat. No. 3,800,759 in column 3, lines 60 etc. thereof.

The temperature sensitive valve 8 is kept closed before the gasoline engine is properly warmed up, and is opened after the gasoline engine is properly warmed up. When the temperature sensitive valve 8 is kept closed, displacement thereof is the same as in the case of the conventional ignition displacement angle control device. However, when the temperature sensitive valve 8 is open, the displacement is reduced to a lower level than that in the case of the conventional ignition displacement angle control device shown in FIG. 1.

More specifically when a gasoline engine-driven vehicle is in the normal state of operation, after proper warming-up of the engine, the throttle valve 2 is set at the position of I shown in FIG. 2, and the temperature sensitive valve 8 is properly warmed up and is open. Therefore, a part of the negative pressure fed through the negative pressure port 3 escapes to the port 6 by way of the pressure-inducing pipeline 10, the restricted orifice 7 and the temperature sensitive valve 8, until the negative pressure is subjected to reduction, thus reducing the displacement angle in a corresponding manner. In this case, the level of the negative pressure to be applied on the diaphragm chamber corresponding to the degree of throttling by the restricted orifice 7 is subjected to a fluctuation and hence different from that in the case shown in FIG. 1. To put it otherwise, reduction in the displacement angle can thus be properly controlled by properly selecting the degree of throttling by the restricted orifice 7.

When the gasoline engine-driven vehicle is running at high speed, the throttle valve is set at the position of II shown in FIG. 2. Therefore, in case virtually the same level of negative pressure as that fed through the port 3 is applied through the port 6 as well, the negative pressure to be applied on the diaphragm chamber 5 becomes the same as that in the former case shown in FIG. 1.

When the gasoline engine-driven vehicle is subjected to acceleration in a rapid manner, the throttle valve is set at the position of II shown in FIG. 2 and is in the same state as when it is running at high speed. However, now that the retarding valve 11 is properly arranged in place between the negative passageway 9 and the diaphragm chamber 5 for the specific purpose of preventing the ignition displacement control valve from being subjected to such rapid displacement as is attributable to rapid acceleration, the retarding valve 11 serves to prevent the displacement from taking place, even it the end of the throttle valve 2 should move to a position above the port 6 for a short period. By way of explanation, this action is attributable to the fact that the retarding valve 11 has a one-way valve 12 and a restricted orifice 13 built therein, and the one-way valve 12 is so designed as to be opened only in case the side of the diaphragm chamber 5 is high enough in terms of negative pressure. The restricted orifice 13 is specifically designed so as to provide the retarding performance for the purpose of keeping the diaphgram chamber 5 free from being affected instantly, even in case the negative pressure applied to the negative pressure port 3 and the port 6 should be increased rapidly at the time of rapid acceleration. As pointed out above, in the case of the present invention, negative pressure displacement can be properly reduced by any desired degree, as well as any desired range of load by effecting a change in the degree of throttling by the restricted orifice 7 and in the height of the port 6 formed through the wall of the vaporizer 1. Furthermore, displacement can be properly checked even in the case of rapid acceleration. Therefore, the ignition time in a gasoline engine can be delayed more than in the case of any conventional ignition displacement angle control device, whereby combustion temperature in the gasoline engine can be lowered, and generation of $NO_x$ can be prevented in an efficient manner.

What is claimed is:

1. In a gasoline engine having a carburetor including a throttle valve and a distributor having a diaphragm chamber, an improved vacuum advancer system for controlling the ignition timing of the engine in response to an engine load, said vacuum advancer system comprising a first port formed in the wall of the carburetor, said first port being positioned upstream of the throttle valve relative to the intake flow when the throttle valve is in a first operating position of the engine at the time the throttle valve is set at the desired position thereof, said first port being positioned downstream of the throttle valve relative to the intake flow when the throttle valve is in a second operating condition of the engine at the time the throttle valve is opened a predetermined value; a second port formed in the wall of the carburetor, said second port being positioned upstream of the throttle valve relative to the intake flow when the throttle valve is in the position corresponding to the second operating condition of the engine, said second port being positioned downstream of the throttle valve when the throttle valve is in a third operating position at the time the throttle valve is opened a further predetermined value slightly beyond said first mentioned predetermined value; a first pipe connected between said first port and the diaphragm chamber; a second pipe connected between said second port and said first pipe; throttling means positioned in said second pipe; and heat sensitive valve means positioned in said second pipe whereby said second pipe communicates with said first pipe only after the engine has warmed up to a predetermined temperature.

2. The vacuum advancer system according to claim 1 wherein said throttling means comprises an internally reduced diameter cross section in said second pipe.

3. The vacuum advancer system according to claim 1 wherein said heat sensitive valve means is comprised of a material that is meltable at the predetermined temperature.

4. The vacuum advancer system according to claim 1 wherein there is further included a third pipe that is in fluid communication with said first and said second pipe at a point intermediate said first port and said throttling means, said third pipe being in fluid communication with the diaphragm chamber of the distributor and including retarding valve means arranged to open as soon as the negative pressure on the side of said retarding valve means adjacent the diaphragm is higher than the negative pressure on the side of said retarding valve means adjacent said first and said second pipes.

5. The vacuum advancer system according to claim 4 wherein said retarding valve means comprises a one-way valve and an orifice.

6. A vacuum advancer system according to claim 1 wherein said second port is located at a position adjacent to an upstream of said first port when the throttle valve is set so that the gasoline engine is subjected to acceleration in a rapid manner.

7. A vacuum advancer system according to claim 1 wherein heat sensitive valve means is such that the ON-OFF action thereof takes place in response to alteration of temperature of the gasoline engine.

8. In a gasoline engine having a carburetor including a throttle valve and a distributor having a diaphragm chamber, an improved vacuum advancer system for controlling the ignition timing of the engine in response to an engine load, said vacuum advancer system comprising: first and second ports formed in the wall of the carburetor, said first and second ports being formed one downstream of the other adjacent the throttle valve, said second port being located between a position where the throttle valve is set when the gasoline engine is subjected to acceleration in a rapid manner and another position where the throttle valve is set for part load after proper warming-up of the engine; a first pipe connected between said first port and the diaphragm chamber; a second pipe connected between said second port and said first pipe; throttling means positioned in said second pipe; and heat sensitive valve means positioned in said second pipe whereby said second pipe communicates with said first pipe only after the engine has warmed up to a predetermined temperature.

* * * * *